US005115280A

United States Patent [19]

Hamada et al.

[11] Patent Number: 5,115,280

[45] Date of Patent: May 19, 1992

[54] RESIDUAL TONER CLEANING APPARATUS FOR COLOR IMAGE FORMING DEVICE

[75] Inventors: Jun-ichi Hamada, Kunitachi; Yukio Okamoto, Hachioji, both of Japan

[73] Assignee: Konica Corporation, Tokyo, Japan

[21] Appl. No.: 654,013

[22] Filed: Feb. 12, 1991

[30] Foreign Application Priority Data

Feb. 14, 1990 [JP] Japan ..... 2-33362

[51] Int. Cl.[5] ..... G03G 21/00

[52] U.S. Cl. ..... 355/299; 355/210; 355/326

[58] Field of Search ..... 355/210, 296, 297, 299, 355/317, 326, 327

[56] References Cited

U.S. PATENT DOCUMENTS 4,451,136 5/1984 Tanioka et al. ..... 355/210
4,888,619 12/1989 Tottori ..... 355/210

FOREIGN PATENT DOCUMENTS 60-75850 4/1985 Japan .
60-76766 5/1985 Japan .
60-95456 5/1985 Japan .
60-95458 5/1985 Japan .
60-158475 8/1985 Japan .
61-100770 5/1986 Japan .
61-149972 7/1986 Japan .
1-196088 8/1989 Japan ..... 355/299

*Primary Examiner*—Joan H. Pendegrass
*Attorney, Agent, or Firm*—Finnegan, Henderson, Farabow, Garrett and Dunner

[57] ABSTRACT

The present invention relates to a color copying apparatus which prevents toner scattering from a tip portion of a cleaner to an image area of an image carrying drum. An exposing device forms a stripe latent image in a stripe area at an upstream of the image area of an image carrying drum in a rotating direction of the image carrying drum, and a developing device stops development within the stripe area. The result is a generation of a sharp potential gap in the stripe area. The cleaner starts cleaning by touching to the stripe area, and accumulated toner on the tip of the cleaner is attracted by the sharp potential gap and is held within the stripe area. This prevents the toner from being scattered to the image area of the image carrying drum.

4 Claims, 6 Drawing Sheets

FIG. 3-A
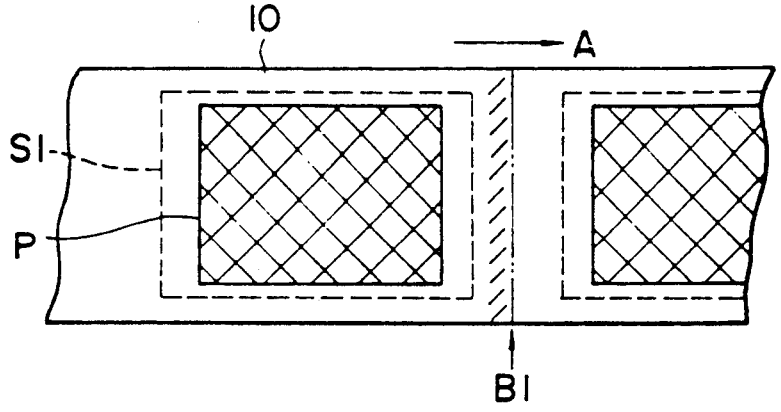
FIG. 3-B
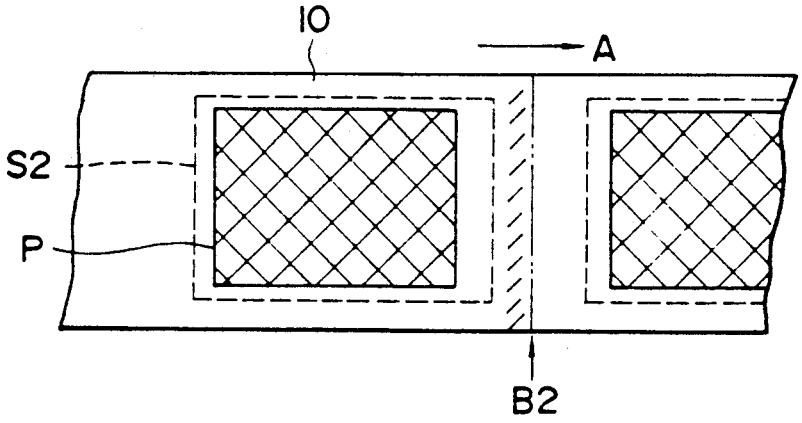
FIG. 3-C
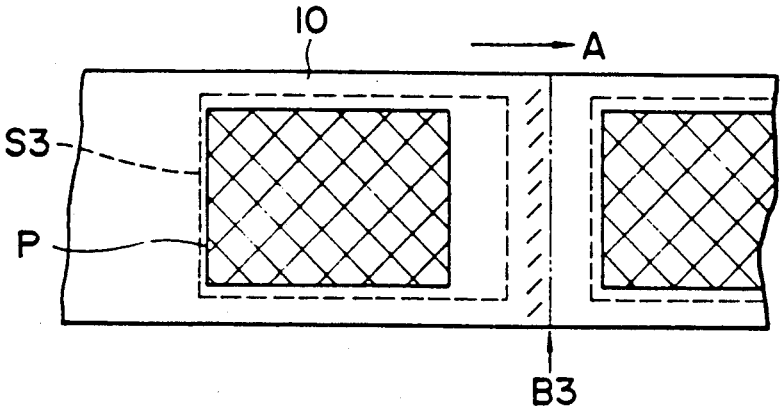

FIG. 4-A
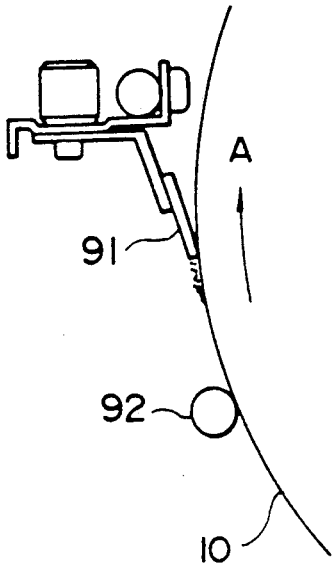
FIG. 4-B
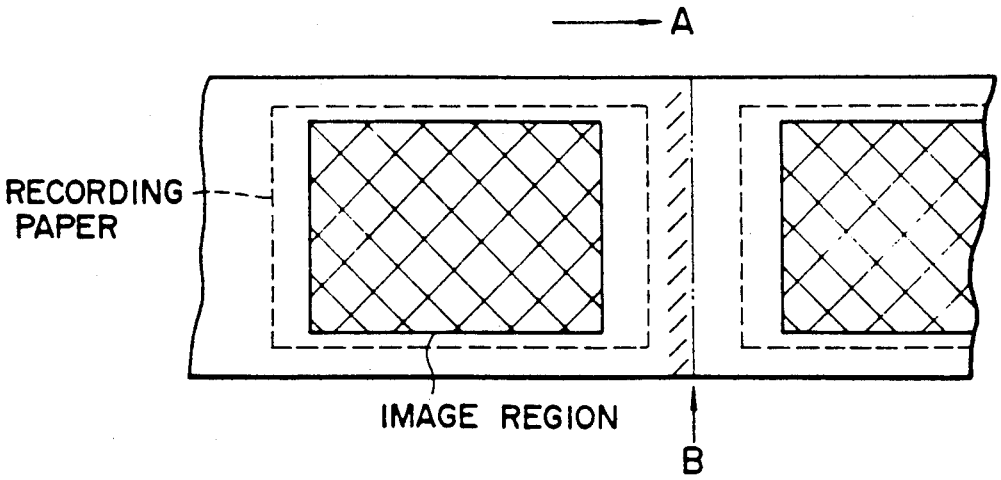

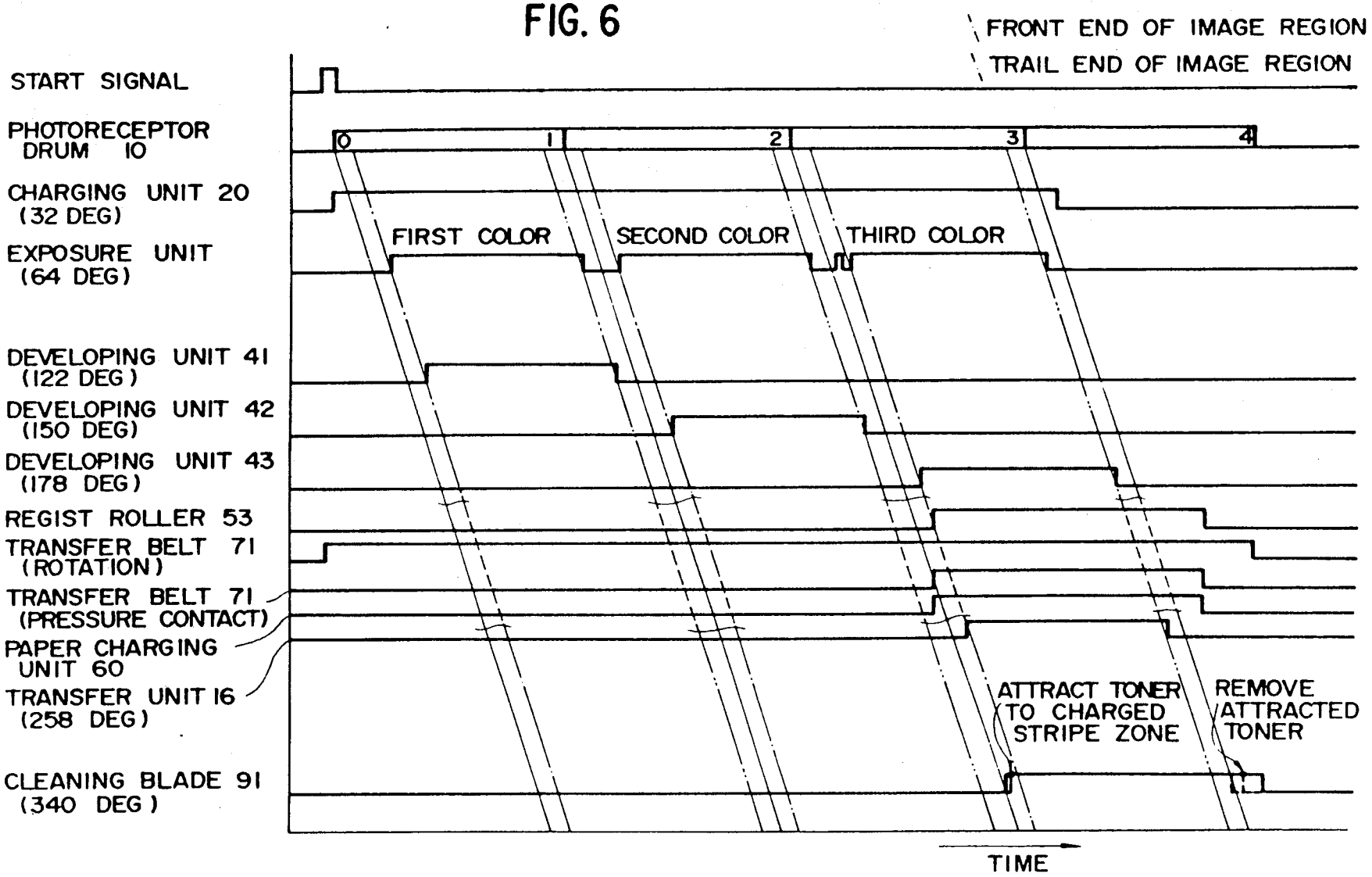
FIG. 6
FRONT END OF IMAGE REGION
TRAIL END OF IMAGE REGION
START SIGNAL
PHOTORECEPTOR DRUM 10
CHARGING UNIT 20 (32 DEG)
EXPOSURE UNIT (64 DEG)
DEVELOPING UNIT 41 (122 DEG)
DEVELOPING UNIT 42 (150 DEG)
DEVELOPING UNIT 43 (178 DEG)
REGIST ROLLER 53
TRANSFER BELT 71 (ROTATION)
TRANSFER BELT 71 (PRESSURE CONTACT)
PAPER CHARGING UNIT 60
TRANSFER UNIT 16 (258 DEG)
CLEANING BLADE 91 (340 DEG)
0
1
2
3
4
FIRST COLOR
SECOND COLOR
THIRD COLOR
ATTRACT TONER (TO CHARGED STRIPE ZONE
REMOVE (ATTRACTED TONER
TIME

RESIDUAL TONER CLEANING APPARATUS FOR COLOR IMAGE FORMING DEVICE

BACKGROUND OF THE INVENTION

The present invention relates to a color image forming apparatus wherein a plurality of developing units each containing a differently colored developer are provided around the peripheral portion of an image-carrier and a plurality of differently colored images developed by aforesaid developing units are superposed on the image carrier and then transferred onto an image-transfer material to be a color image.

Many methods and apparatuses for obtaining a color image through an electrophotographic method have been proposed. In the method disclosed in Japanese Patent Publication Open to Public Inspection No. 100770/1986 (hereinafter referred to as Japanese Patent O.P.I. Publication), for example, formation of latent image and development thereof in the number of times corresponding to the number of colors separated from an image on an original are made on a photoreceptor drum that is an image-carrier, and an image of each color is transferred onto a transfer drum for each development to form thereon a multicolor image which is transferred onto a recording paper to be a color image. An apparatus based on this method requires a transfer drum having the size to cover by its circumferential surface an image equivalent to one entire sheet in size, in addition to a photoreceptor drum. Thus, it is impossible to avoid the apparatus being large and complicated. Further, in the method disclosed in Japanese Patent O.P.I. Publication No. 149972/1986, for example, formation of latent image and development thereof in the number of times corresponding to the number of colors separated from an image on an original are made on a photoreceptor drum and each developed image is transferred, for each development, onto a transfer material to form a multicolor copy. In this method, it is difficult to superpose images each being in different color accurately in position, thus, it is impossible to obtain a color copy with an excellent quality.

There further is a method wherein formation of latent image and development thereof by means of color toner are repeated for the number of times corresponding to the number of colors separated from an image on an original, and after color toner images are superposed on a photoreceptor drum, they are transferred to become a color image. The basic processes of the multicolor image forming mentioned above are disclosed in Japanese Patent O.P.I. Publication Nos. 75850/1985, 76766/1985, 95456/1985, 95458/1985 and 158475/1985.

In the multicolor image forming apparatus for forming a color image through superposition mentioned above, a plurality of developing units each containing a differently colored toner are provided around a peripheral portion of a photoreceptor drum, and the photoreceptor drum is generally caused to make plural turns, thereby to cause a latent image thereon to be developed to be a color image.

The photoreceptor drum is generally caused to make plural turns, and during that period, toner images each having a different color are superposed on a photoreceptor drum, then they are transferred onto a transfer material which, after completion of transfer thereonto, is subjectedto fixing and is ejected to the outside of an apparatus. The photoreceptor drum from which the toner images have been transferred, on the other hand, is cleaned by a cleaning means located at the downstream side from the transfer position for the next image forming process.

As a cleaning means, a cleaning blade or a rotating fur brush is used, and it is kept away from the photoreceptor drum during the period of image forming, and after the transferring of images is completed, it is caused to be in contact with the photoreceptor drum and scrapes off residual toners thereon to clean the circumferential surface of the photoreceptor drum. Waste toners scraped off are collected and conveyed to a waste toner box. However, it is impossible to convey all waste toners collected to the waste toner box, and accordingly, a part of waste toners stay, for example, on the surface of an edge portion or the like at the tip of the cleaning blade. As shown in FIG. 4-A, such toners staying on the tip of the edge portion sometimes drop on a drum surface while cleaning blade 91 is retreating or leaving the circumferential surface of photoreceptor drum 10 after being released from its pressure contact on photoreceptor drum 10, and stay again on the photoreceptor drum surface.

FIG. 4-B shows a circumferential surface of the photoreceptor drum developed in its rotation direction shown with arrow A. Aforesaid toner staying portion (a hatched portion) is located successively at the upstream side against the point B where the cleaning blade starts retreating. However, since most of such staying toners stay in a relatively narrow area, an amount of staying toners which are transferred to a recording paper is relatively small when the recording paper that is an image-transfer material is fed to the ordinary position against an image for transferring thereof.

However, when the recording paper is fed slightly earlier than the image for the purpose of providing 'a binding margin' and others, aforesaid toner staying portion interferes in the recording paper zone, resulting in the margin (binding margin) soiled with toners.

As stated above, toners staying on a cleaning means stick to the portion in the vicinity of the position where toners scraped from the image carrier stay, but a part of them move to other potential gap generated by other process and stay there.

When toners staying on a potential gap portion on a photoreceptor drum are developed, such toners cause an image soil problem for an image formed in the next cycle. This phenomenon causes a problem in a color image forming apparatus wherein a color image is formed on a photoreceptor drum through a plurality of rotations of the photoreceptor drum. An object of the present invention is to provide a color image forming apparatus which offers a clean image having no image soil.

BRIEF DESCRIPTION OF THE DRAWINGS

FIG. 6 is a time chart showing a process of image forming in other example of the invention.

SUMMARY OF THE INVENTION

Above-mentioned object is attained by a color image forming apparatus comprising a plurality of developing units each being for different color arranged on a circumferential surface of an image carrier by which color images are superposed on the image carrier and then transferred onto a recording paper and comprising a cleaning means provided, for cleaning, to be capable of touching and leaving the image carrier from which the images have been transferred, wherein the timing for aforesaid cleaning means to leave the image carrier is controlled so that it is in a certain relation with the timing for feeding a recording paper.

Further, aforesaid object is attained by a color image forming apparatus comprising an image carrier whose circumferential surface is provided with a plurality of developing means by which the toner images are superposed on the image carrier and subjected to reversal development to be transferred onto an image-transfer material and comprising a cleaning means that cleans the image carrier from which the images have been transferred, wherein a non-image area on aforesaid image carrier is subjected to an exposure in a form of a band and such exposed portion in a band shape is cleaned without being subjected to development.

DETAILED DESCRIPTION OF THE INVENTION

Figure 1:
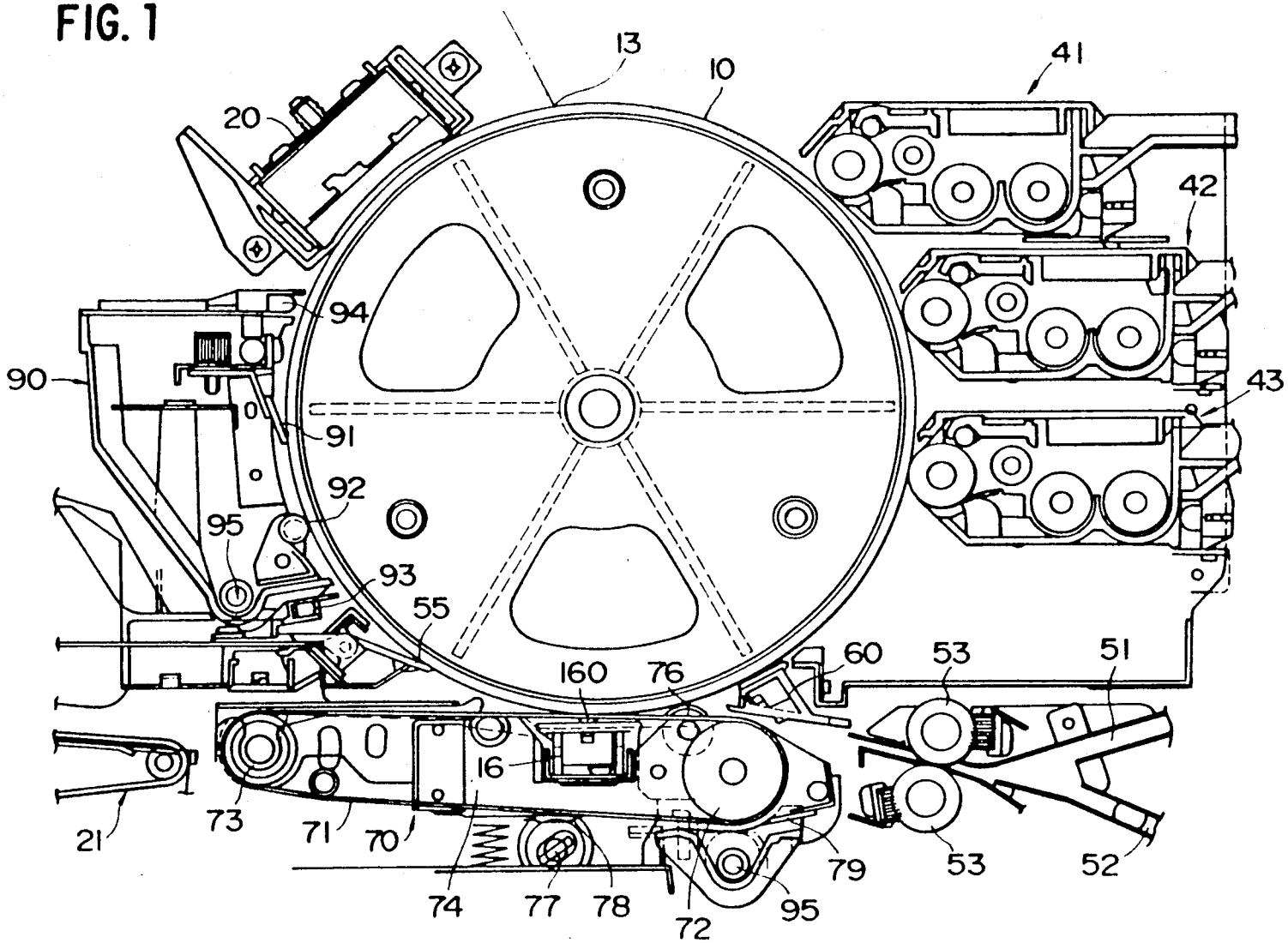
FIG. 1 shows a sectional structural view of a color image forming apparatus of the invention.

FIG. 1 is a sectional structural view showing an example of an image forming apparatus of the invention.

In the figure, the numeral 10 represents an image carrier in a drum shape, namely, a photoreceptor drum which is composed of a drum coated with OPC photoreceptor and is grounded and rotates clockwise for driving. The numeral 20 is a scorotron charging unit that charges a photoreceptor on a circumferential surface of aforesaid photoreceptor drum 10, the numeral 13 is an exposure location to which exposure light or a laser beam is projected, for focusing on the circumferential surface of photoreceptor drum 10, through unillustrated optical system for exposure.

A unit of a laser-writing type, for example, is used for aforesaid optical system for exposure. When color signals generated from an image reading device that is separated from aforesaid image forming apparatus are inputted into aforesaid unit of a laser-writing type, a laser beam (of a wavelength of 780 nm) is emitted from a semiconductor laser. The laser beam is swung by a rotating polygon mirror, and then is deflected by a reflecting mirror in terms of an optical path after passing through an $f\theta$ lens, and finally projected on the circumferential surface of photoreceptor drum 10 uniformly charged, in advance, by aforesaid charging unit 20.

After scanning is started, on the other hand, the laser beam is detected by an index sensor and thereby modulation of the laser beam by the first color signal is started, and thus the circumferential surface of aforesaid photoreceptor drum 10 is scanned by the modulated laser beam. Therefore, main scanning by means of the laser beam and sub-scanning by means of rotation of photoreceptor drum 10 form a latent image for the first color on the image area on photoreceptor drum 10. This latent image is subjected to reversal development by means of a developing means containing first color toner, yellow (Y) for example, thus yellow toner image is formed on the circumferential surface of photoreceptor drum 10. The toner image thus obtained on the image area passes under a transfer means and a cleaning means where both are kept away from the circumferential surface of photoreceptor drum 10 during above developing time interval, and so the toner image is held safely on the circumferential surface of photoreceptor drum 10.

After that, aforesaid photoreceptor drum 10 is charged again by aforesaid charging unit 20, then the second color signals generated from a signal processing unit are inputted in aforesaid unit of a writing type, and writing for the second color signals on the circumferential surface of photoreceptor drum 10 is performed similarly to the occasion of the first color signals, thus a second latent image is formed. This latent image is subjected to reversal development by means of a developing means containing second color toner, magenta (M) for example, thus a magenta toner image is formed. This magenta toner image is formed so that it is superposed on aforesaid yellow toner image formed in the previous step.

Toner images thus obtained pass under a transfer means and a cleaning means both being kept away from the circumferential surface of photoreceptor drum 10.

In the same way, writing for the third color is performed on photoreceptor drum 10 and thereby a latent image is formed. This latent image is subjected to reversal development by means of a developing means containing third color toner, cyan (C) for example. The cyan toner image thus obtained is formed so that it is superposed on aforesaid yellow and magenta toner images, thus a color image is obtained. Sometimes, black toner image formed by a developing means containing black toner is further superposed similarly to the aforesaid occasion to obtain a color image with a high image quality.

The numerals 41-43 represent developing units which are developing means containing respectively yellow, magenta and cyan toners, and they are much alike in terms of structure.

The embodiment shows a case where the cleaning blade 91 retracts from the photorecepter drum after the transfer of the toner image. The present invention, however, is not limited to the above embodiment. The cleaning blade may be retracted from the photoreceptor drum before an arrival of the first toner image for a succeeded color image.

Following steps are required to form each color toner image; charging of the photoreceptor drum 10 by the charging unit 20 provided around the peripheral surface of the photoreceptor drum, exposure by means of a unit of a laser-writing type and development processing by means of each one of developing units 41-43. These steps are repeated three times to form three color toner images to be superposed on the image area on the circumferential surface of photoreceptor drum 10.

Each of the numerals 51 and 52 represents a path for a recording paper of different size group that is an image-transfer material fed one sheet by one sheet from an image-transfer material supplying unit, and 53 represents a resist roller for conveying a recording paper to transfer unit 160 synchronizing with movement of aforesaid color toner image on photoreceptor drum 10.

The numeral 70 is a transfer belt unit, 71 is a transfer belt that is a belt portion, 72 and 73 represent a roller made of conductive metal materials and roller 72 on the upstream side is a roller having a rotatable shaft and grounded or kept at a certain potential that is almost close to the grounded level, and roller 73 located at the downstream side is a roller which has a fixed shaft and is for driving transfer belt 71. The numeral 74 is a belt-supporting member and its one end is connected fixedly to the shaft of roller 73 to be coaxial therewith, the other end is connected to the movable shaft of roller 72, and the belt-supporting member is urged by unillustrated elastic member so that roller 72 may be located at the lower position. Therefore, transfer belt 71 is normally kept away from the circumferential surface of photoreceptor drum 10, while for transferring, eccentric am 77 operated by the control of a control unit of the apparatus pushes up belt-supporting member 74 through leaf spring 78, thereby the belt-supporting member swivels counterclockwise around roller 73, thus rollers 76 provided at both edges of belt-supporting member 74 touch both end portions other than image area on the circumferential surface of photoreceptor drum 10 and transfer belt 71 is caused to touch transfer portion 160 on photoreceptor drum 10.

The numeral 79 is a cleaning blade of a belt-cleaning unit that scrapes off toners sticking to transfer belt 71 and the numeral 95 is a toner-conveying tube having therein a flexible toner-conveying screw and conveys toners scraped off by cleaning blade 79 into unillustrated a toner-collection box.

The numeral 16 is a transfer device that is a charger for transferring provided at a location facing transfer portion 160, and the numeral 60 is a paper-charging unit provided at the position to face roller 72 in the wedge-shaped space between transfer belt 71 and photoreceptor drum 10 so that the opening portion of the paper-charging unit faces transfer belt 71.

After development conducted by developing unit 43 containing toners of the third color is started on photoreceptor drum 10 in the manner mentioned above, functioning of resist roller 53, pressure-contact action of transfer belt unit 70 and high voltage impression on a discharge wire of paper-charging unit 60 take place almost at the same time.

Owing to the foregoing, a recording paper fed out from an image-transfer material supplying unit one sheet by one sheet is subjected to corona discharge conducted by paper-charging unit 60, thus, the recording paper is charged to be the same as toners on photoreceptor drum 10 in terms of polarity. Aforesaid paper-charging unit 60 charges with electricity efficiently and surely with roller 72 which is in the state close to the grounded condition as an opposing electrode, and it is located extremely closely to transfer portion 160. Therefore, the loss of charges caused during the transportation is small and the recording paper can be transported to transfer portion 160 while it is firmly attracted to transfer belt 71.

When the leading edge of the recording paper arrives at transfer portion 160, the recording paper is caused by transfer belt 71 to be in pressure-contact to photoreceptor drum 10. Then, transfer charging unit 16 charges with electricity whose polarity is opposite to that of toners on photoreceptor drum 10, and thereby aforesaid toner images are transferred onto a recording paper. The recording paper on which toner images have been transferred is further conveyed by conveyance belt 21 and arrives at unillustrated fixing portion where fixing is made through heating and fusing. After that, the recording paper is ejected onto an ejection tray outside. The numeral 55 is a separation claw for preventing a recording paper from going up.

Photoreceptor drum 10 images on which have been transferred through rotation and pressure-contact of aforesaid transfer belt 71 and charging action by transfer charging unit 16 is cleaned by cleaning unit 90 which is provided with cleaning blade 91 that is a cleaning means and toner-collection roller 92 that collects residual toners electrostatically. Aforesaid cleaning blade 91 is kept away from the surface of the photoreceptor drum while toner images are being formed thereon, and after transferring is finished, it is caused to be in pressure-contact to photoreceptor drum 10 for cleaning it. Further, neutralizing lamp 93 is positioned at the upstream side of cleaning unit 90 and neutralizing lamp 94 is positioned at the downstream side thereof. Neutralizing lamp 93 neutralizes the circumferential surface of photoreceptor drum 10 so that residual toners thereon can easily be removed, and neutralizing lamp 94 neutralizes uniformly the cleaned circumferential surface of photoreceptor drum 10 so that the cleaned circumferential surface can be charged uniformly. Further, there is provided, on the bottom of cleaning unit 90, toner-conveying tube 95 having therein a toner-conveying screw made of flexible materials thereby waste toners collected after cleaning are conveyed to unillustrated toner-collection box. Aforesaid cleaned photoreceptor drum 10 enters next image forming process.

Figure 2:
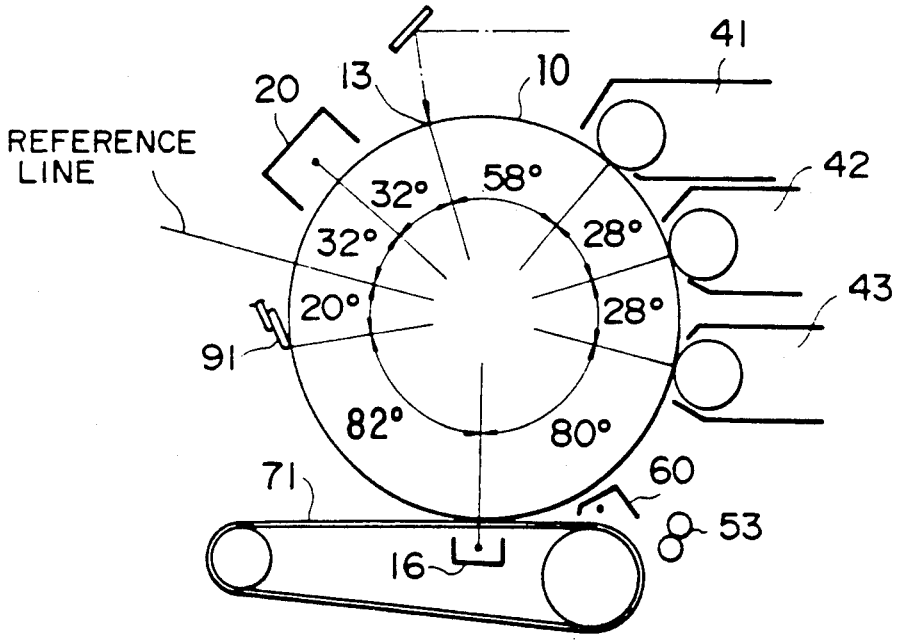
FIG. 2 is an illustration showing the relation in terms of position of each image forming means, FIGS. 3-A–3-C represent illustrations showing actual examples for providing 'a binding margin', and FIGS. 4-A and 4-B represent illustrations related to margin soil caused by waste toners.
Figure 5:
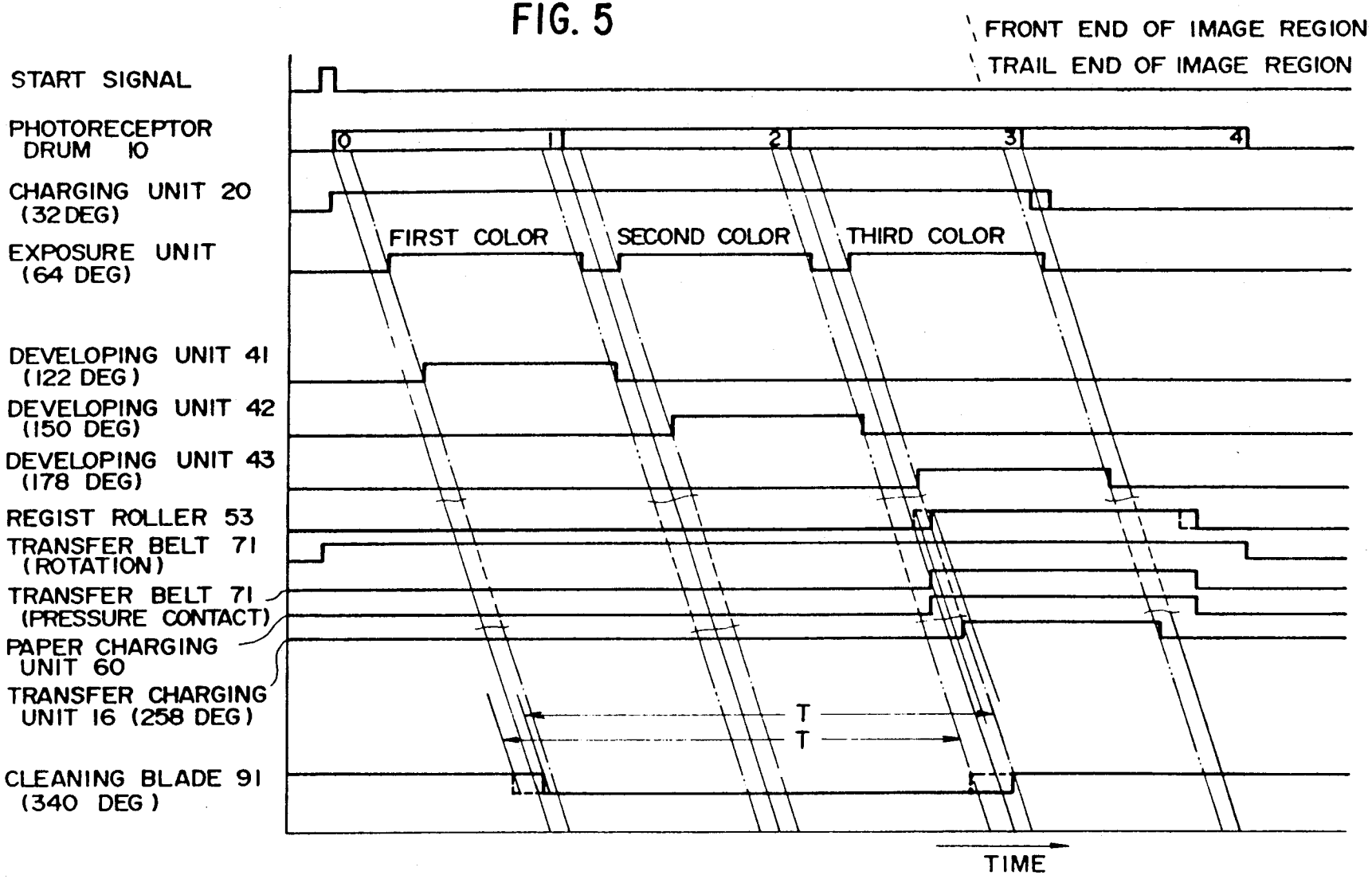
FIG. 5 is a time chart showing a process of image forming in an example of the invention.

In aforesaid image forming apparatus, each image forming means is provided around photoreceptor drum 10 to keep the position relation shown in FIG. 2, and its image forming process is controlled by the sequence shown in a time chart on FIG. 5.

It is desirable that the range to be cleaned by cleaning blade 91 that is kept to be in contact with photoreceptor drum 10 is as large as possible. In the invention, the timing for cleaning blade 91 to retreat in aforesaid cleaning unit 90, namely the timing for cleaning blade 91 to leave the circumferential surface of photoreceptor drum 10 is controlled to keep a constant time interval T from the timing for feeding a recording paper, namely the timing for resist roller 53 to operate in recording paper conveyance system.

Therefore, when the timing for resist roller 53 to start operating is advanced to the time shown by a dashed line for the purpose of allowing a binding margin, the timing for cleaning blade 91 to retreat is automatically advanced to the time shown with a dashed line, thus aforesaid constant time interval T can be kept.

FIGS. 3-A to 3-C show the foregoing situation concretely. As shown in FIG. 3-A, retreating point B1 for cleaning blade 91 is so determined as to avoid an interference of a toner-staying portion (hatched portion) with recording paper S1 that has been fed so that toner image P is transferred to a normal position, and based on the normal condition mentioned above, aforesaid time interval T is established as a basic control parameter.

In the case when the position of recording paper S1 in relation to toner image P is controlled through manipulation on an operation panel to move to upstream side against rotation of a drum shown as S2 or S3 in FIG. 3-B or FIG. 3-C for the purpose of providing a binding margin, retreating point P of cleaning blade 91 is automatically moved by the same length in the same direction to be the position of B2 or B3, resulting in avoidance of interference of recording paper S2 or S3 with a toner-staying portion and of consequent soil caused by attached toners.

In the example, the problem of soil in the margin on a recording paper caused by waste toner removed by cleaning and sticking on the margin is solved, thereby it has become possible to offer a color image forming apparatus which is capable of providing freely a binding margin on a recording paper and is extremely useful for practical use.

Next, other example of the invention will be explained as follows. A copying machine to be embodied in the present example is the same as one explained in FIGS. 1 and 2 in aforesaid example, therefore, explanation of overlapped portions will be omitted.

In an image forming apparatus shown in FIG. 1, each image forming means is arranged around the photoreceptor drum 10 as shown in FIG. 2, and its image forming process is controlled by the sequence shown in a time chart in FIG. 6.

Immediately before starting exposure on the circumferential surface of photoreceptor drum 10 by means of the third color signals, bandwise exposure is conducted on a non-image area that is advanced in position from the leading edge of an image area by about 20 mm, thus a bandwise latent image zone that is about 3 mm in width and is long in the direction of drum width is formed.

With regard to bandwise exposure, its pattern and its width are not limited but are allowed to be a straight line or a group of spotwise exposures.

It is recommended that a sharp potential gap is generated in the stripe zone for tight holding of the toner transferred from the tip portion of the cleaning blade. In the embodiment, a laser beam for the exposure of a latent image is also utilized for forming the stripe image, and so, there is no need of special device such as charging means or a particular laser beam as a light source for forming the stripe image. In the embodiment, the photoreceptor drum is charge at an electrostatic potential of 700 to 800 Volt by the pre-charging unit 20, and the electrostatic potential becomes 0 to 100 Volt after the exposure, and any other measures capable of generating such a sharp electrostatic potential gap may be used instead of the laser beam above mentioned.

The bandwise exposure portion in the peripheral surface of the photoreceptor drum is notated as 'stripe zone' in FIG. 6. As known from the time sequence in the figure, the bandwise exposure portion does not receive a developing action from the developing means 41, nor a transfer action from the transfer unit 160, and preserves a characteristic as a potential gap portion.

When the cleaning blade 91 becomes in contact with the photoreceptor drum, separated toner from the tip portion of the cleaning blade is attracted and held within the bandwise exposure portion. As a result, the toner from the cleaning blade 91 is accumulated in a non-image area, namely, the bandwise exposure portion, and other portions of the photoreceptor drum are prevented from being contaminated with the dispersed toner.

At the end of cleaning time interval by the cleaning blade, aforesaid toner held on the non-image area of photoreceptor drum 10 can be removed again by the blade 91 by slightly extending the cleaning time interval, thus, collected toner can mostly be collected in a toner-collection box.

In the present example, explanation has been made on an image forming apparatus wherein a color image is composed with three toner images each having its own color. However, the invention can also be applied, in the same manner, to a color image forming apparatus wherein an image is composed with four toner images each having its own color including also black toners. In this case, an effect identical to the foregoing can be obtained by conducting bandwise exposure so that a potential gap is generated on a non-image area at the leading edge of an image when imagewise exposure with the fourth color is conducted.

In the present example, it is possible to collect waste toners removed from a photoreceptor through cleaning without causing them to stay on an image surface of the photoreceptor, and concurrently with that, it is possible to start effective cleaning constantly with a cleaned cleaning means having no residual toners thereon. As a result, it has become possible to provide a color image forming apparatus capable of offering color images of high quality free from deterioration of image quality caused by waste toners which are sticking again or staying.

What is claimed is:

1. An apparatus for forming a color image, comprising:

a rotatable image carrying member having an image area for carrying a latent image corresponding to the color image;

means for forming the latent image in the image area and a stripe latent image other than in the image area, the stripe latent image being formed at an upstream side of the image area with respect to a rotation of the image carrying member;

means for developing the latent image with a plurality of different color toners to form a color image composed of a plurality of toner images on the image carrying member, each of the toner images corresponding to the different color toners;

wherein a latent image formation and a development are repeated by the latent image forming means and the developing means during a plurality of the rotation of the image carrying member so as to form the color image;

means for transferring the color image onto a transfer sheet;

means for cleaning residual toner from the image carrying member; and means for abutting the cleaning means to the surface of the image carrying member so that the stripe latent image attracts the toner from the cleaning means after the transferring, wherein the abutting means releases the cleaning means from the image carrying member so as not to deteriorate the toner image.

2. The apparatus of claim 1, wherein the developing means forms a color image composed of the plurality of the color images by reversal development.

3. The apparatus of claim 1, wherein the stripe latent image is formed before a final color latent image is formed at the image area.

4. An apparatus for forming a color image, comprising:

a rotatable image carrying member having an image area;

means for forming a plurality of latent images corresponding to an original image in the image area of the rotatable image carrying member;

means for developing a color image in the image area by superimposing a plurality of color toner images, each of said color toner images being developed from each of said latent images;

means for transferring the color image from the image area of the image carrying member to a recording sheet;

means for feeding the recording sheet to the transferring means, which starts feeding at a feed time;

means for varying the feed time; and means for cleaning the image area of the image carrying member, which retracts from the image area to stop cleaning after a predetermined time from the feed time.

* * * * *